United States Patent [19]

Jacobsson

[11] Patent Number: 4,736,601

[45] Date of Patent: Apr. 12, 1988

[54] YARN FEEDING DEVICE

[75] Inventor: Kurt A. G. Jacobsson, Ulricehamn, Sweden

[73] Assignee: Aktiebolaget IRO, Ulricehamn, Sweden

[21] Appl. No.: 8,510

[22] PCT Filed: May 20, 1986

[86] PCT No.: PCT/EP86/00305

§ 371 Date: Jan. 13, 1987

§ 102(e) Date: Jan. 13, 1987

[87] PCT Pub. No.: WO86/06765

PCT Pub. Date: Nov. 20, 1986

[30] Foreign Application Priority Data

May 17, 1985 [SE] Sweden ..... 8502436

[51] Int. Cl.[4] ..... D04B 15/50

[52] U.S. Cl. ..... 66/132 R

[58] Field of Search ..... 66/132 R, 132 T, 232

[56] References Cited

U.S. PATENT DOCUMENTS

| | | | |
|---|---|---|---|
| 3,303,671 | 2/1967 | Oliver Jr. | 66/132 R |
| 3,590,601 | 7/1968 | Sugiura | 66/132 R |
| 3,858,416 | 1/1975 | White et al. | 66/132 R |

FOREIGN PATENT DOCUMENTS

| | | | |
|---|---|---|---|
| 161853 | 11/1985 | European Pat. Off. . | |
| 3002311 | 7/1981 | Fed. Rep. of Germany | 66/132 R |
| 1585278 | 12/1969 | France | 66/132 R |
| 737561 | 9/1955 | United Kingdom . | |
| 861880 | 3/1961 | United Kingdom | 66/132 R |
| 1120227 | 7/1968 | United Kingdom . | |
| 1380224 | 1/1975 | United Kingdom | 66/132 R |

*Primary Examiner*—Wm. Carter Reynolds

*Attorney, Agent, or Firm*—Flynn, Thiel, Boutell & Tanis

[57] ABSTRACT

A yarn feeding device adapted for positively feeding elastic yarn comprises an electric motor, a speed sensor for the speed of the knitting machine and a control unit connected to the electric motor and to the speed sensor. An optimal dynamic behavior of the yarn feeding device is obtained by making use of a rotatable drive cylinder connected to the electric motor, of a rotatable guide shaft supporting the yarn supply spool, which shaft is slidably arranged such that the yarn supply spool is kept in permanent contact with the drive cylinder, wherein the control unit drives said rotatable drive cylinder with a variable speed depending on the actual speed of the knitting machine and on a yarn demand signal, wherein the range of yarn feeding speeds is limited by predetermined minimum and maximum values.

5 Claims, 3 Drawing Sheets

YARN FEEDING DEVICE

FIELD OF THE INVENTION

The present invention relates to a yarn feeding device.

BACKGROUND OF THE INVENTION

In the recent years, there has been an increasing demand in knit articles containing elastic yarn or rubber yarn, like so-called uncovered elastomeric yarns, these knit articles being surgical hoses, swimsuit fabrics, ladies stockings, socks and elastic body stockings, which have become very fashionable in the recent time. These knit goods are usually comprised of a certain percentage of elastic yarn and a certain percentage of non-elastic yarns. Usually, these goods have a size varying along the length of the goods. Often, these goods have an essentially tubular shape with varying diameter. One of the main problems in the knitting of these goods consisting of elastic fabrics is to achieve a predetermined form and size of the good being stable from product to product. Variations in the shape and size of the goods are caused by varying stitch densities in fabrics caused by numerous variable factors in the knitting process, for example caused by a varying yarn tension.

In the recent years, knitting machines for elastic yarns are usually equipped with yarn feeding devices for positively feeding predetermined quantities of elastomeric yarn to the working needles in the respective knitting station in the knitting machine. The term of positive feeding means that the yarn is not withdrawn from a yarn supply spool due to tensions in the yarn caused by the knitting process of the working needles, but means that the rate of withdrawal of yarn from a yarn supply spool is determined by the operation of the yarn feeding device, usually working in synchronism with the knitting machine.

Most of the prior art feeding devices for positively feeding elastomeric yarn to knitting stations of the knitting machine are mechanically coupled to a main motor drive of the knitting machine be means of a pin wheel and a belt drive mechanism for ensuring a synchronus operation of the respective feeders and the main drive motor of the knitting machine. A predetermined ratio of the yarn feeding speed with respect to the operational speed of the knitting machine can be adjusted by making use of a so-called quality wheel determining the belt speed for driving the feeders with respect to the rotational speed of the main shaft of the knitting machine by mechanically changing the diameter of the quality wheel. A variation in the feeding speed with respect to the operational speed of the knitting machine results in a variation in the stitch density and in turn in a diameter variation of the tubular good made by the knitting machine.

Feeding devices mechanically coupled to the knitting machine as described above have been manufactured and widely distributed by the applicant.

A similar prior art is examplified by GB-A No. 737561, GB-A No. 861880 and by GB-A No. 1380224.

GB-A No. 1380224 discloses a knitting machine having feeding devices mechanically coupled to the main drive of the knitting machine by means of a driven friction wheel allowing a changing of the gear ratio between the driving and the driven friction wheel for changing the knitting density. The gear ratio is determined by a mechanism coupled to a needle cam, the position of which determines the knitting density of the knit fabric.

Aktiebolaget Iro Wricehamn, Sweden distributes a yarn feeding device adapted to be mechanically coupled and driven by the main drive motor of the knitting machine by means of a pin wheel and a belt drive mechanism. This prior art yarn feeding device is called "IRO IEPF YARN FEEDER" this yarn feeding device is comprised of a vertical yarn spool carrier for carrying a spool of yarn adapted to be rotatable about an axis. The spool is pressed against a rotatable, vertical cylinder which is driven by the pin wheel engaging the drive belt.

It is known from DE-A No. 3002311 to make use of an electric motor drive for feeding elastic yarn from a still-standing supply spool to the knitting stations of a knitting machine. The prior art yarn feeding device is controlled by a microprocessor connected to a speed sensor for sensing the operational speed of the knitting machine. Although this knitting machine having a mechanically independent drive of the yarn feeder with respect to the main drive of the knitting machine is regarded as being advantageous since it is not restricted in the scope of positioning the feeding devices with respect to the remaining knitting machine, it has turned out to be unacceptable for high-speed implementations because of a lack in feeding-accuracy resulting in undesired changes in the mesh size or stitch density of the elastic fabric knitted by said machine.

The prior, non-prepublished European Patent application No. 161853 describes a knitting machine having electrically driven yarn feeding devices equipped with variablespeed electric motors driven by programmed controlled units connected to a speed sensor for detecting the operational speed of the knitting machine. A single electric drive motor drives a quality wheel which in turn engages a drive belt driving numerous feeding devices having the usual mechanical structure.

SUMMARY OF THE INVENTION

In view of this state of art, the present invention is based on the object of further enhancing the yarn feeding accuracy of a yarn feeding device of the above mentioned kind.

This object is solved by a yarn feeding device in accordance with the invention.

In accordance with the present invention, the yarn feeding device is equipped with a rotatable drive cylinder connected to the electric drive motor and with a yarn supply spool fixed to a rotatable guide shaft, which guide shaft is slidably arranged and pre-biassed by a spring such that the yarn supply spool is kept in permanent contact with the drive cylinder driven under the control of a drive unit with a variable yarn feeding speed depending on the actual operational speed of the knitting machine and on a yarn demand signal, wherein the range of yarn feeding speeds in limited by minimum and maximum values, which values are empirically determined and pre-set in the control unit of the feeding device.

The drive cylinder is directly coupled to the electric motor and engages the circumferential surface of the yarn supply spool which is kept in contact with the surface of the drive cylinder. It has turned out that this kind of mechanical arrangement of the feeding device shows an excellent dynamic behaviour of the yarn feeding device when equipped with an electric stepping motor. The entire system consisting of the knitting machine, the feeding device, the electric motor and the control unit for generating the drive signals for the electric motor has proven to have an excellent dynamic behaviour without any tendancy of oscillating yarn tensions in response to step-like increasing or decreasing yarn demands, which occurred in systems of the kind as described in the DE-OS No. 3002311 when operating these systems with a high operational speed. The latter behaviour of the prior art system making use of an electric drive of the yarn feeding devices which is not mechanically coupled to the main shaft of the knitting machine has until yet prevented a wide-spread use of these systems. In contrast hereto, the claimed system can be driven in the high-speed range whilst ensuring a high-size accuracy of the knit good.

BRIEF DESCRIPTION OF THE DRAWINGS

The invention will now be described with reference to the enclosed drawings which illustrate, diagrammatically and by way of example, one preferred embodiment of the invention. In the drawings.

DETAILED DESCRIPTION

Figure 1:
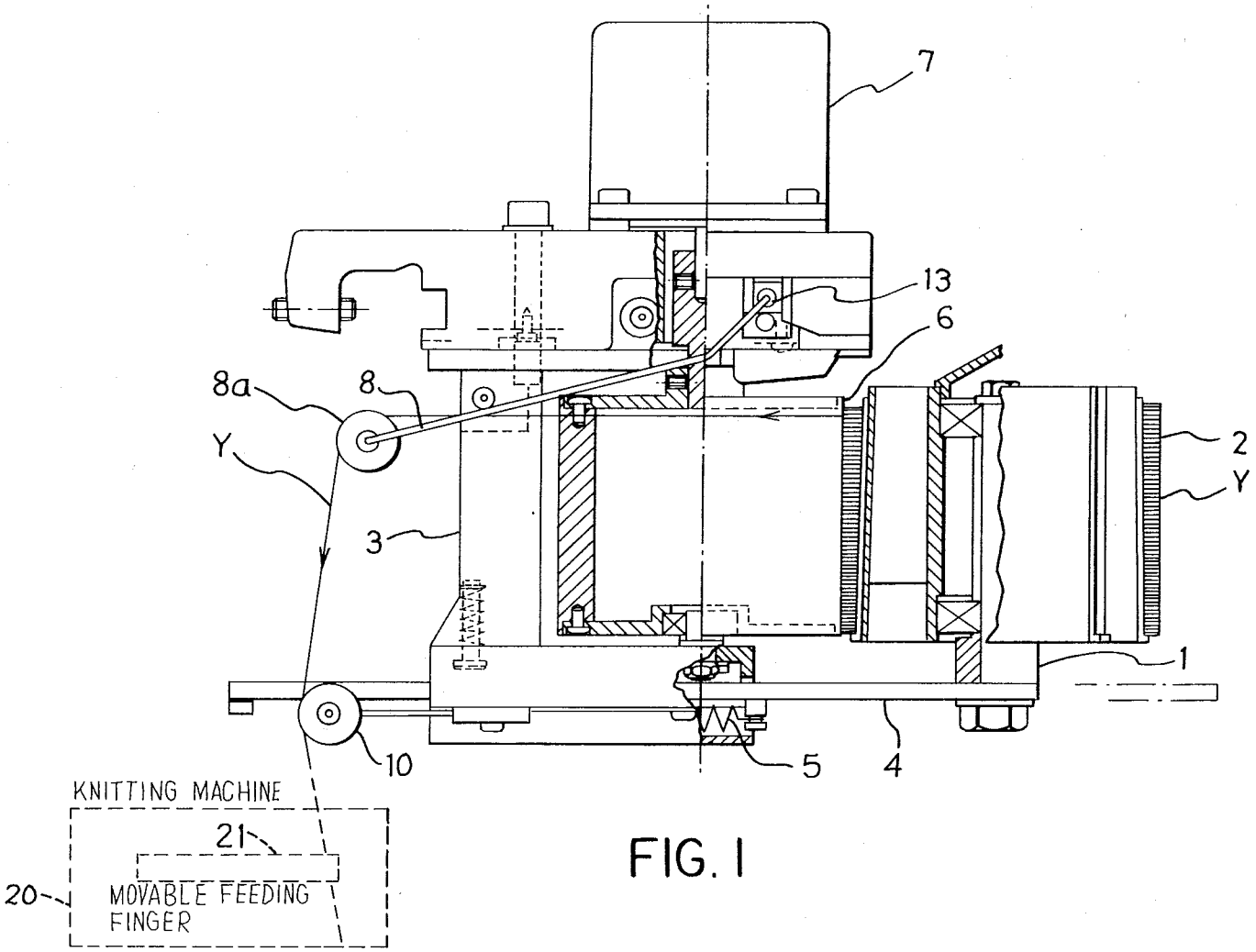
FIG. 1 illustrates a side-elevation view of a preferred embodiment of the yarn feeding device in accordance with the present invention, partially in cross-sectional representation.
Figure 2:
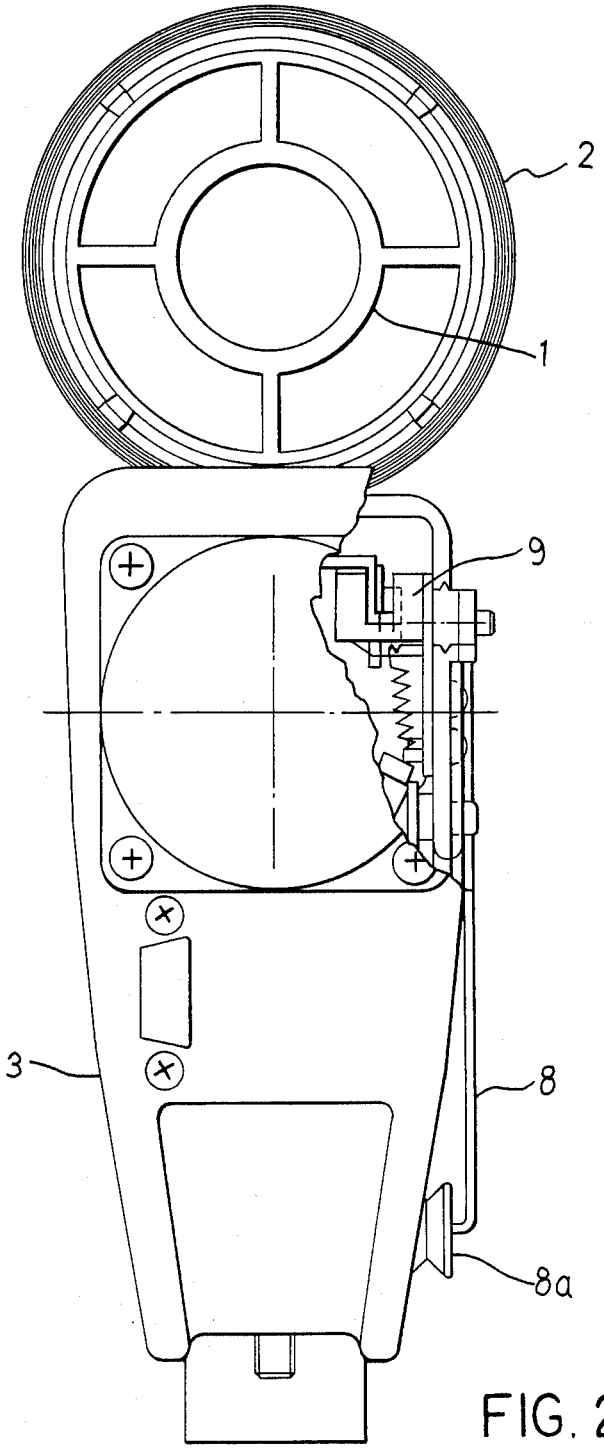
FIG. 2 shows a top view of the yarn feeding device in accordance with FIG. 1.

The yarn feeding device in accordance with FIGS. 1 and 2 has a vertical yarn spool carrier 1 carrying a spool 2 of elastomeric yarn. The yarn spool carrier 1 is adapted to be rotatable around its axis. The elastomeric yarn is preferably a so-called uncovered elastomeric yarn. The yarn spool carrier 1 is secured to a guide bar 4 slidably arranged with respect to a housing 3 of the yarn feeding device. A drive cylinder 6 is rotatably drawn out with respect to said housing 3 . The cylinder 6 is arranged to be driven by an electric motor 7 secured to a top side of the feeding device. A draw spring 5 urging the guiding bar 4 towards the axis of the drive cylinder 6 keeps the circumferential surface of the yarn spool 1 in permanent contact with the cylinder surface of the vertical drive cylinder 6 . In the preferred embodiment, the electric motor is a stepping motor 7 commercially available in the market and manufactured by IBM. This stepping motor is distributed under the designation number Hy 200-2220-210-A-B8. This stepping motor has until now primarily been used as drive units for various kinds of printers.

Figure 3:
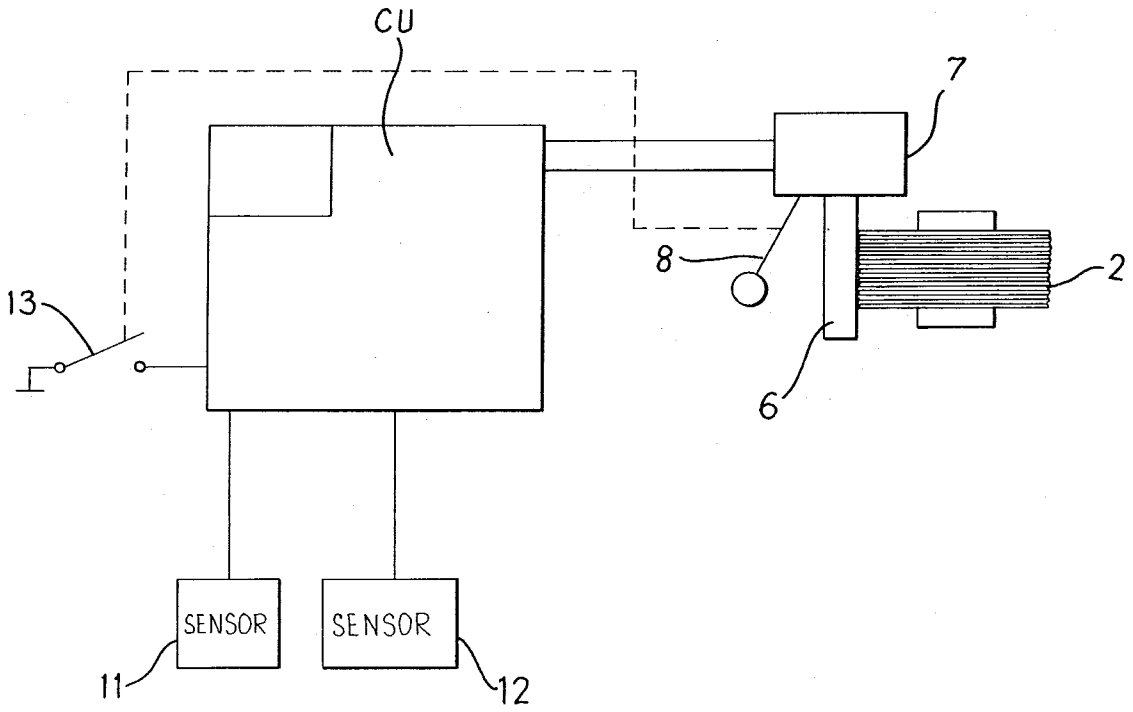
FIG. 3 shows a block diagram of a control circuit for driving the yarn feeding device in accordance with FIGS. 1 and 2.

Due to the above described arrangement of the electric motor 7 , the driving cylinder 6 and the vertical yarn spool 2 , the circumferential speed of the cylinder 6 determined by the rotational speed of the stepping motor 7 determines the yarn feeding velocity of the yarn leaving the spool 2 . The yarn leaving the spool 2 in the tangential direction is running over a part of the circumference of the cylinder 6 and then passes over a very lightly journalled wheel 8*a* on a yarn guiding arm 8 which is pivotally drawn-out to the housing 3 of the yarn feeding device. The arm 8 is coupled to an electrical contact 13 located in the housing 3 . As shown at FIG. 3, a control unit CU is connected to said contact 13 in case the contact 13 is closed in response to an essential reduction in yarn tension due to a yarn breakage or a yarn over-feed as detected by the guiding arm 8 , in response to which the control unit CU causes a stopping of the electric motor 7 and of the knitting machine itself. The yarn Y leaving the wheel 8*a* runs over a further guiding wheel 10 to a yarn intake of the knitting machine, which is shown diagrammatically at 20 in the figures.

The control unit is also connected to a speed sensor 11 for detecting the operational speed of the knitting machine. This sensor 11 generates a pulse train representing the speed of the knitting machine. The sensor may be an opto-electric sensor generating 20–300 pulses per knitting machine revolution. The control unit CU is further connected to a sensor 12 for the actual yarn demand varying in the course of the knitting process due to the fact that the machine is knitting a stocking with a stitch size varying over the length of the stocking in accordance with the desired shape thereof. The sensor is preferably a contactless type, like an inductive sensor. The sensor 12 is adapted for generating an output signal representing the vertical position of the needle cam or of the cylinder of the knitting machine. The yarn demand signal can also be obtained by directly deriving it from machine control means for the verical position of the needle cam or of the needle cylinder. This vertical position as detected by the sensor 12 has a positional range of about 2 to 3 millimeters. This relatively small movement can be geared in any suitable way for optimising the accuracy of the sensor 12 . The sensor 12 preferably generates an analog signal. However, the sensor 12 may be also a digital one for generating for example 10 digital steps or levels corresponding to 10 predetermined vertical positions of the needle cam or of the needle cylinder of the knitting machine.

The control unit CU generates a drive signal for controlling the rotational speed of the electric stepping motor 7 such that it is in synchromism with the rotational speed of the circular knitting machine, so that the relative speed of the yarn with respect to the operational speed of the knitting machine depends on the actual position of the needle cam or of the needle cylinder indicating the actual yarn demand.

The positive feeding operation is switched on and off in response to the actual position of a yarn feed finger 21 located at the yarn intake of the knitting machine. Alternatively, the switching on and off of the positive feeding may be carried out in response to an output signal of a control unit for the yarn feed finger, which feed finger brings the yarn in contact and out of contact with the working needles in the knitting machine.

The switching on is carried out by generating a drive signal having a ramp-like form, the characteristics of which are adjusted and predetermined in advance in the control unit CU. During the starting of the opertion of the yarn feeding device, the rotational speed of the electric stepping motor 7 is steadily increased to a value which is determined firstly by the pulse number representing the actual operational speed of the knitting machine, secondly by the actual position of the needle cam or of the needle cylinder in the knitting machine and thirdly by the actual setting of a maximum and minimum speed value, both values being pre-adjusted in the control unit CU in a way which will be described in detail hereinafter.

After receipt of a stop-signal from the contact 13 actuated by the yarn guiding arm 8 , the control unit CU actuates a stop relay for reducing the rotational speed of the electric stepping motor 7 to zero and for stopping the knitting machine itself. In case the stop-signal is received from the contact in a working position corresponing to the inactive position of the yarn feeding finger, the stop-signal will be disregarded for avoiding erroneous stops. For this purpose it may be necessary in certain cases to make use of a short time delay of the stop signal.

The yarn feeding device in accordance with the present invention is adjusted before taking it into operation as follows:

the respective ramp-like function for the starting operation and for the stopping operation are set at respective maximum values. This setting of the disired maximum values can be carried out by making use of a code-coupler.

Thereinafter, the knitting machine is adjusted with regard to the vertical position of the needle cam or of the needle cylinder for continuous operation with a minimum yarn demand for forming small stitches as required for knitting the narrowest part of the knit article, like the stocking.

Said minimum value of the rotational speed of the electric stepping motor 7 is manually adjusted by the operator. In doing so, the operator takes care that the yarn demand sensor generating a signal representing the vertical position of the needle cam or of the needle cylinder is not in its end position. The minimum value is adjusted such that said value is increased in case the yarn tension in the yarn Y leaving the yarn feeding device turns out to be unacceptably high or in case a yarn breakage occurs. On the other hand, said minimum value is decreased by lowering the rotational speed of the electric stepping motor 7 in case the yarn tension turns out to be unacceptably low or in case a yarn over feed occurs.

Thereinafter, the maximum value of the rotational speed of the electric stepping motor 7 is set approximately 20% higher than the minimum value obtained by the above indiated procedure. By doing so, the machine is adjusted for forming large stitches for knitting the widest part of the stocking. A fine adjusting of the maximum value is obtained by a procedure similar to the precedure for setting the minimum value.

The characteristics of the starting ramp are adjusted by making use of a full yarn spool 2 such that an over feed does not take place when switching on the stepping motor whilst preventing any excessive yarn tensions being present at the moment of the starting of the knitting of the elastic yarn.

The stop ramp characteristics are adjusted such that a yarn surplus will be obtained so that there is enough time for introducing elastic yarn under low yarn tension. By doing so, the deceleration is slow enough so that any deformations of the yarn supplied on the yarn spool are prevented.

The present invention is not limited to the above described embodiment. For example, the electric signal representing the actual position of the yarn guiding arm 8 moving from a first position in which the machine is working with the elastic yarn to a second position in which the yarn is pulled out of operation by the yarn feeding finger, can also be used as a signal for the switching on and off of the electric motor 7 .

The embodiments of the invention in which an exclusive property or privilege is claimed are defined as follows:

1. In a yarn feeding device which is adapted for positively feeding elastic yarn from a yarn supply spool to a knitting machine and which includes:

a drive unit for driving said yarn feeding device, and a rotatable drive cylinder connected to said drive unit, wherein said yarn supply spool is arranged to be prebiased against said drive cylinder such that the circumferential surface of said yarn supply spool is kept in permanent contact with said drive cylinder;

the improvement comprising wherein:

said drive unit is an electric motor;

said yarn feeding device comprises a speed sensor for generating a speed signal representing the actual operational speed of the kntting machine;

said yarn feeding device comprises a control unit connected to said electric motor and to said speed sensor for generating a drive signal for said electric motor;

said drive signal generated by said control unit causes said rotatable drive cylinder driven by said electric motor to feed said yarn with a variable yarn feeding speed to said knitting machine;

said variable yarn feeding speed depends on the actual operational speed of said knitting machine represented by said speed signal and further depends on a yarn demand signal, and said variable yarn feeding speed is within a range of yarn feeding speeds limited by a minimum value and a mximum value, which values are empirically predetermined and preset in said control unit.

2. Yarn feeding device as claimed in claim 1, wherein said control unit causes starting and terminating of the positive feeding of yarn in response to repective positions of a movable yarn feeding finger.

3. Yarn feeding device as claimed in claim 1, wherein a starting opertion under the control of said control unit includes a ramp-like increasing of the yarn feeding speed.

4. Yarn feeding device as claimed in claim 1, wherein said yarn demand signal is generated by a sensor for the position of a needle cam of the kntting machine.

5. Yarn feeding device as claimed in claim 1, wherein said yarn demand signal is generated by a sensor for the position of a needle cylinder of the knitting machine.

* * * * *